US010279822B2

(12) United States Patent
Gao

(10) Patent No.: US 10,279,822 B2
(45) Date of Patent: May 7, 2019

(54) TELESCOPIC TYPE COLLISION ENERGY ABSORPTION DEVICE FOR RAIL VEHICLE

(71) Applicant: CENTRAL SOUTH UNIVERSITY, Changsha, Hunan (CN)

(72) Inventor: Guangjun Gao, Changsha (CN)

(73) Assignee: Central South University, Changsha (CN)

( * ) Notice: Subject to any disclaimer, the term of this patent is extended or adjusted under 35 U.S.C. 154(b) by 0 days.

(21) Appl. No.: 15/520,391

(22) PCT Filed: Oct. 15, 2016

(86) PCT No.: PCT/CN2016/102231
§ 371 (c)(1),
(2) Date: Apr. 19, 2017

(87) PCT Pub. No.: WO2017/063600
PCT Pub. Date: Apr. 20, 2017

(65) Prior Publication Data

US 2018/0208219 A1 Jul. 26, 2018

(30) Foreign Application Priority Data

Oct. 16, 2015 (CN) ..... 2015 1 0666711

(51) Int. Cl.
*B61F 19/04* (2006.01)
*B61F 99/00* (2006.01)

(52) U.S. Cl.
CPC ..... *B61F 19/04* (2013.01); *B61F 99/00* (2013.01)

(58) Field of Classification Search
CPC ..... B61F 19/04; B61F 99/00
(Continued)

(56) References Cited

U.S. PATENT DOCUMENTS 4,182,529 A 1/1980 Taylor
2003/0034659 A1* 2/2003 Summe ..... B60R 19/34 293/133

(Continued)

FOREIGN PATENT DOCUMENTS

CN 2618820 Y 6/2004
CN 2647679 Y 10/2004

(Continued)

OTHER PUBLICATIONS

Supplementary European Search Report in European application No. 16854975.6, dated Dec. 14, 2017.

(Continued)

*Primary Examiner* — Joseph D. Pape
(74) *Attorney, Agent, or Firm* — Syncoda LLC; Feng Ma

(57) ABSTRACT

A telescopic type collision energy absorption device includes a first tube, a second tube telescoped within the first tube, and a telescopic mechanism connected with the second tube by passing through the first tube, the first tube being mounted with a cutting mechanism for cutting an outer wall of the second tube, when the device is in a non-operating state, the telescopic mechanism pulls the second tube to retract into the first tube; in a state prior to the collision of a vehicle, the telescopic mechanism under an effect of high-pressure air pushes the second tube to eject outwards, the cutting mechanism is pressed against locating slots of the second tube under an effect of a spring force, the cutting mechanism cuts the second tube and absorbs energy when the second tube is subjected to an external force and retracts towards interior of the first tube.

17 Claims, 6 Drawing Sheets

(58) Field of Classification Search
USPC ..... 293/132, 133
See application file for complete search history.

(56) References Cited

U.S. PATENT DOCUMENTS

| | | | | |
|---|---|---|---|---|
| 2005/0029795 | A1 | 2/2005 | Camp | |
| 2005/0035584 | A1 | 2/2005 | Camp | |
| 2007/0120384 | A1* | 5/2007 | Parkinson | B60R 19/34 293/132 |
| 2009/0065462 | A1 | 3/2009 | Gansweidt | |
| 2012/0325108 | A1* | 12/2012 | Graf | B61D 15/06 105/392.5 |
| 2016/0152247 | A1 | 6/2016 | Sano et al. | |

FOREIGN PATENT DOCUMENTS

| | | | |
|---|---|---|---|
| CN | 201472283 | U | 5/2010 |
| CN | 102107664 | A | 6/2011 |
| CN | 201989738 | U | 9/2011 |
| CN | 103863351 | A | 6/2014 |
| CN | 204527205 | U | 8/2015 |
| CN | 104925080 | A | 9/2015 |
| EP | 1247716 | A1 | 10/2002 |
| FR | 2528928 | A1 | 12/1983 |
| WO | 03035452 | A1 | 5/2003 |
| WO | 2015015747 | A1 | 2/2015 |

OTHER PUBLICATIONS

International Search Report in international application No. PCT/CN2016/102231, dated Jan. 11, 2017.

* cited by examiner

TELESCOPIC TYPE COLLISION ENERGY ABSORPTION DEVICE FOR RAIL VEHICLE

TECHNICAL FIELD

The disclosure relates to the field of the passive safety of a rail vehicle, and in particular to an energy absorption device for use in a vehicle collision.

BACKGROUND

With the development of the railway transportation and a continuous increase in the operating speed of rail vehicles, vehicle running safety has received increasing attention. Despite of an emergency braking is performed before a collision of a rail vehicle against an obstacle, collision accidents often arise because of the large inertia and the high speed of the rail vehicle. Once a collision accident occurs, it may cause disastrous effects resulting in damage of a rail vehicle and casualties. A countermeasure that has gained significant popularity all over the world lies in that an energy absorption structure is mounted at an end portion of the vehicle so that the energy absorption structure can absorb energy in case of a collision accident of a vehicle, thereby ensuring the safety of passengers and the vehicle.

Chinese utility model Publication No. CN201989738U entitled "Pneumatic Telescopic Type Collision-buffering Energy Absorption Device of Automobile" proposes a telescopic energy absorption structure which can slide back and forth in a casing. The energy absorption structure can be pushed out quickly and achieves a reliable self-locking. Upon a collision, the energy absorption structure suffers from collapse deformation to absorb the energy. When there is no collision, the energy absorption structure can be retracted by pulling out a self-locking bolt.

Chinese Patent Publication No. CN102107664A entitled "Vehicle Cutting Energy Absorption Device For Rail Locomotive" proposes a cutting energy absorption device in which: a test-piece to be cut is fixed and a cutter head is located on a cutter bar. When a collision is applied to the cutter bar, the cutter head cuts the test-piece to be cut to absorb the energy.

A collapse deformation is employed in the afore-described pneumatic telescopic type collision-buffering energy absorption device of automobile. Although the energy absorption structure is hidden within the casing before deformation and does not occupy the outer space, there may be a residual deformation after the collapse deformation of the energy absorption structure, this would make inefficient use of the deformation stroke.

Cutting energy absorption is employed in the afore-described vehicle cutting energy absorption device for rail locomotive. The energy absorption structure is exposed to an exterior of the energy absorption device and occupies the outer space, but the cutter bar may intrude into the interior of the energy absorption device, thus there is no residual deformation of the structure, and the deformation stroke is fully used.

There are also energy absorption structures which occupy a front space before the deformation and have residual deformation after the deformation.

To this end, the disclosure provides a telescopic type collision energy absorption device for a rail vehicle. An energy absorption element is hidden within the energy absorption device in normal times and does not occupy the outer space. When a collision occurs, the rapidly projected energy absorption structure employs cutting energy absorption and can be fully retracted into the interior of the energy absorption device, the residual deformation is not generated and the effective deformation stroke is fully used.

SUMMARY

In order to improve the passive safety and aesthetic appearance of the rail vehicle, the disclosure provides a telescopic type collision energy absorption device for a rail vehicle exclusively used in the case of a collision of the rail vehicle. The device is hidden within vehicle when the vehicle is running normally and does not negatively impact the aesthetic properties of the vehicle; the energy absorption structure of the energy absorption device may project rapidly and absorb the energy when a collision occurs, there is no residual deformation generated in the collision, and the deformation stroke can be fully used.

A collapse type energy absorption structure fixed at an outer end of the vehicle is used in most of the existing locomotives and vehicles, which negatively impact the aesthetic properties of the vehicle. The curving performance of the vehicle is compromised in case of an extended energy absorption structure. Thus, the length of structure is limited. In this case, if the collapse type energy absorption structure which generates the residual deformation is used, the energy absorption ability of the structure will be compromised. Although there is an existing telescopic type energy absorption structure which does not compromise the aesthetic properties of the vehicle in normal times, it also use the collapse type energy absorption structure which may causes the residual deformation and compromises the energy absorption ability of the whole structure. The disclosure provides a telescopic type collision cutting energy absorption device for a rail vehicle, an energy absorption structure of which is hidden within vehicle in normal times and does not compromise the aesthetic properties of the vehicle. During a collision, the energy absorption structure can project sufficiently and produce no residual deformation, thereby fully using the deformation stroke thereof and improving the energy absorption ability of the structure effectively.

The technical solutions of the disclosure are implemented as follows.

There is provided a telescopic type collision energy absorption device for a rail vehicle, including: a first tube and a second tube that can telescope within the first tube, the first tube is mounted with a cutting mechanism for cutting an outer wall of the second tube, the energy absorption device includes a telescopic mechanism connected with the second tube by passing through the first tube, when the energy absorption device is in a non-operating state, the telescopic mechanism pulls the second tube in such a way that the second tube is retracted into the interior of the first tube, in a state prior to [[the]] collision of the vehicle, the telescopic mechanism under the effect of a high-pressure air pushes the second tube in such a way that the second tube is ejected outwards, the cutting mechanism is pressed against locating slots of the second tube under the effect of a spring force, the cutting mechanism cuts the second tube and absorbs energy when the second tube is subjected to an external force and retracts towards the interior of the first tube; after the energy absorption circular tube is damaged by a collision, only the energy absorption structure is replaced during maintenance rather than replacement of the entire device; When subjecting to a certain vertical or lateral force, the energy absorption structure may occur a stable longitudinal deformation and move longitudinally along the guide cartridge.

In an embodiment, the telescopic mechanism is driven by a double-acting type air cylinder, a double-acting type hydraulic cylinder, or an electric motor that drives a gear rack.

When the telescopic mechanism is driven by the double-acting type air cylinder, the telescopic mechanism comprises the double-acting type air cylinder, a double-acting type solenoid valve, an air storage tank and a controller; in the non-operating state, the controller activates a second position of the double-acting type solenoid valve in such a way that a second position of the double-acting type air cylinder is inflated by the high-pressure air in the air storage tank via a gas circuit, such that the double-acting type air cylinder is in a state of tension where it pulls and retracts the second tube into the interior of the first tube; in the state prior to the collision of the vehicle, the controller activates a first position of the double-acting type solenoid valve in such a way that a first position of the double-acting type air cylinder is inflated by the high-pressure air in the air storage tank via a gas circuit, and the second tube is pushed by the double-acting type air cylinder under the effect of the high-pressure air and is ejected outwards.

In an embodiment, the cutting mechanism comprises cutters and a cutter base; in the non-operating state, the cutting mechanism is pressed against the outer wall of the second tube by the cutters; in the state prior to the collision of the vehicle, the cutters mounted on the cutter base are capable of rotating and separating from the second tube, such that the cutters are again pressed, under the effect of the spring force, against the locating slots of the second tube ejected outwards.

In an embodiment, the cutting mechanism further comprises cutter fixing blocks, bolts, torsional springs and pins, each cutter is connected with two of the cutter fixing blocks by one of the pins, a counter bore is provided on each of the cutter fixing blocks on one side of a pin bore, each torsional spring is wrapped around a corresponding pin, the torsional spring is connected at one end to the cutter and at other end to one of the two cutter fixing blocks, the cutters are pressed against the second tube by spring force of the torsional springs; the cutter fixing blocks are fixed on the cutter base by the bolts.

In an embodiment, each cutter is rotated and separated from the second tube by using a pull ring or an air cylinder below the cutter for jacking up the cutter; the pull ring is mounted on the cutter, the cutters on the cutter base can be rotated and separated from the second tube by being pulled through the pull rings, so as to allow a replacement of the cutters after being damaged.

In an embodiment, the first tube comprises a guide cartridge which is a hollow circular tube, the guide cartridge is provided at one end with a first flange part through which the guide cartridge is fixed to the cutter base, and the other end of the guide cartridge is connected to a base of the energy absorption device.

In an embodiment, an inner end of the second tube is provided with a second flange part, the cutter base is provided with a third flange part embedded within the first tube, the second flange part is in clearance fit with an inner wall of the first tube, the position of the second flange part is limited by the third flange part.

In an embodiment, an outer end of the second tube is provided with an anti-climber, an inner end of which is embedded in an inner chamber of the first tube, and the locating slots are provided on an outer wall in the second tube.

There is further provided a rail vehicle, the rail vehicle is mounted with the telescopic type collision energy absorption device for a rail vehicle according to any one of the above solutions, the energy absorption device is mounted on a rail vehicle driven by a high-pressure air of the rail vehicle itself or on a tool requiring energy absorption, which requires an additional provision of the high-pressure air; and the energy absorption device is automatically controlled by a sensor mounted on the rail vehicle, or controlled manually.

In a preferred embodiment of the rail vehicle, two sets of the energy absorption devices are provided on the rail vehicle, and the two sets of the energy absorption devices are mounted respectively on either side of an end portion of the vehicle.

The disclosure has the following beneficial effects: the telescopic type collision energy absorption device for a rail vehicle is hidden within the vehicle body when it does not work, and does not compromise the entirety aesthetic; when a collision occurs, the telescopic type collision energy absorption device for a rail vehicle may project rapidly, and absorb the energy by generating a large deformation, the deformation stroke of the structure can be fully used for absorbing the energy, the safety of the vehicles and passengers is ensured, an energy absorption structure of the telescopic type collision energy absorption device for a rail vehicle may also be retracted into the interior of the vehicle when the structure is triggered improperly. Furthermore, the device has a simple structure, is convenient to be replaced in case of damage, and can be controlled automatically.

BRIEF DESCRIPTION OF THE DRAWINGS

The present disclosure will be further explained with reference to the drawings, in which.

DETAILED DESCRIPTION

The objectives, solutions and advantages of embodiments of the disclosure will become clearer upon reading the following detail description of the solutions in the embodiments of the disclosure, given with reference to the accompanying drawings. The embodiments described herein are part of the embodiments of the disclosure but not all of the embodiments.

The disclosure proposes a telescopic type collision energy absorption device for a rail vehicle, which includes two sets of mechanisms functioning individually. The two sets of mechanisms are mounted respectively on either side of end portion of the vehicle.

Figure 1:
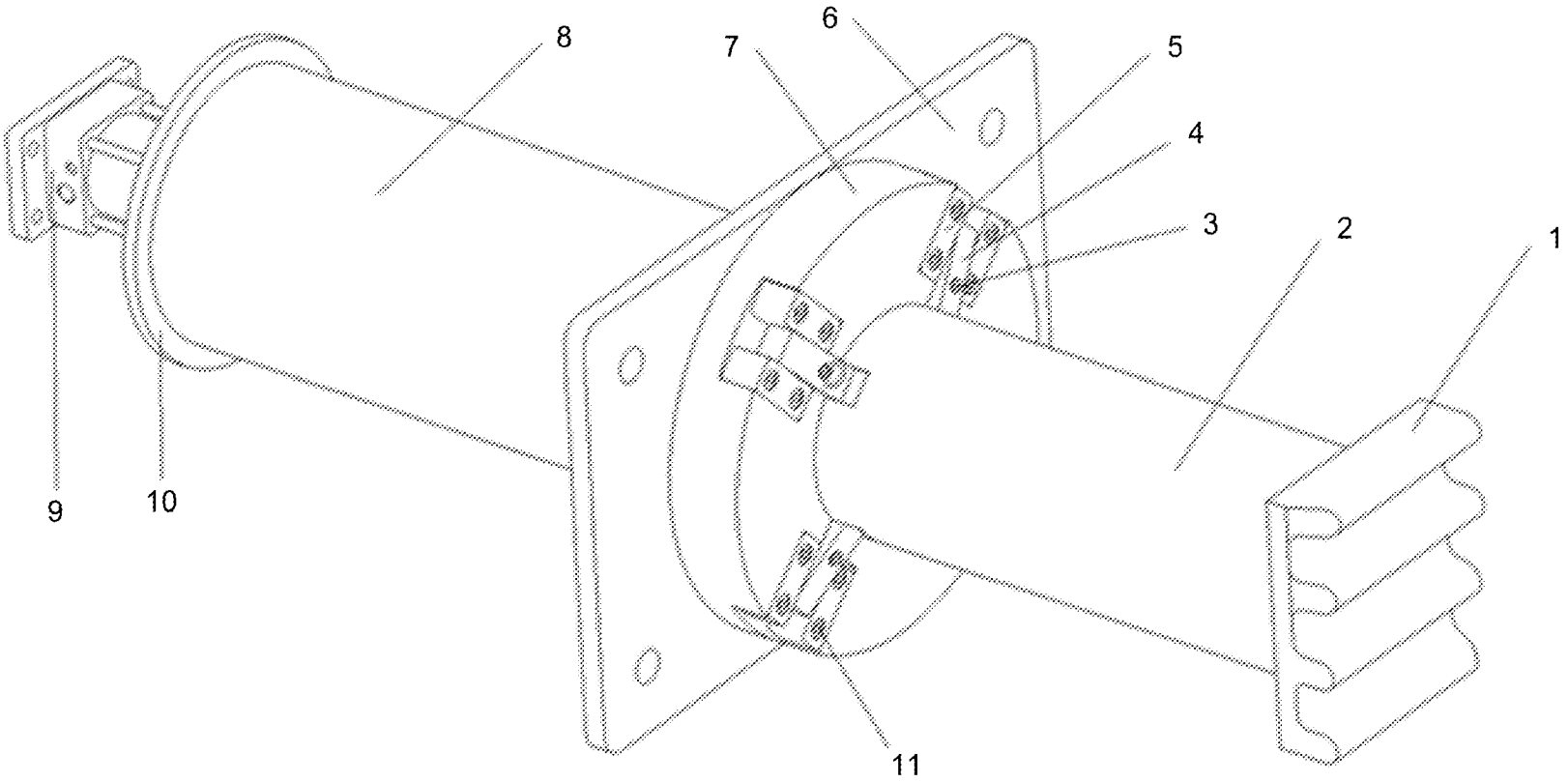
FIG. 1 is a structural schematic diagram of an energy absorption device according to the disclosure.
Figure 2:
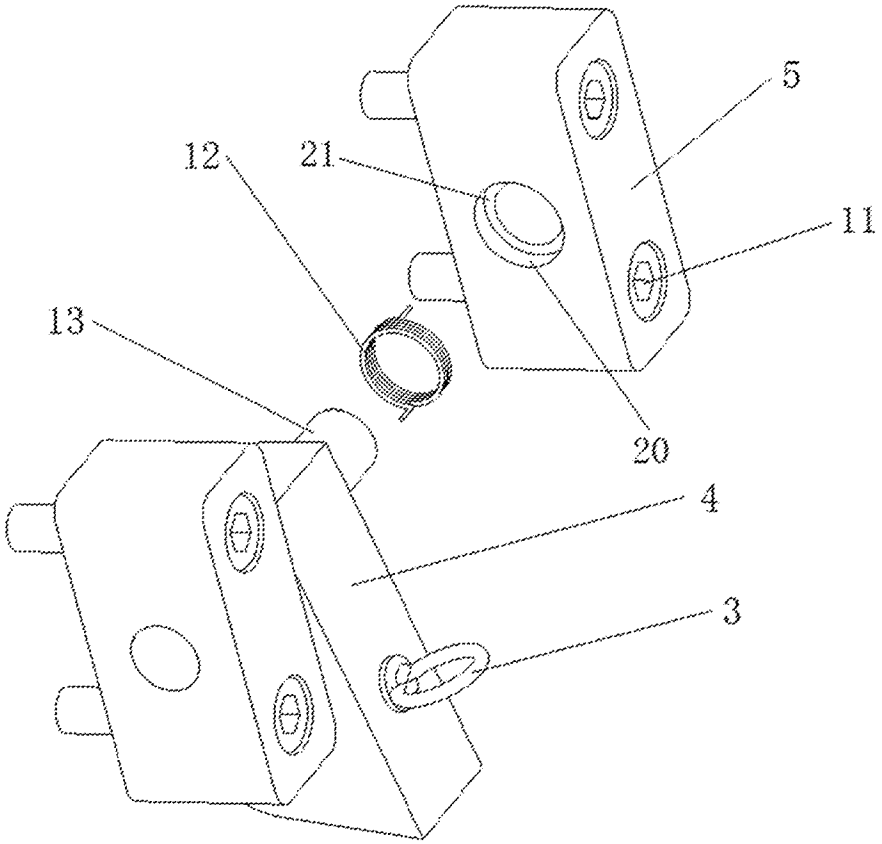
FIG. 2 is an installation schematic diagram of a cutter structure of the disclosure.

As shown in FIGS. 1 and 2, the mechanical structure of the energy absorption device includes an anti-climber 1, an energy absorption circular tube 2, pull rings 3, cutters 4, cutter fixing blocks 5, a mounting base 6, a cutter base 7, a guide cartridge 8, a double-acting type air cylinder 9, a rear base 10, bolts 11, torsional springs 12 and pins 13. The energy absorption device is mounted on a vehicle body by the mounting base 6 which is fixed on the vehicle body by bolts. The mounting base can be individually manufactured based on various different types of structures of the vehicle body, or can be previously mounted on the vehicle during manufacture of the vehicle. A base of the double-acting type air cylinder 9 is fixed on the vehicle body by bolts. The double-acting type air cylinder 9 may also be a double-acting type hydraulic cylinder, or is driven by an electric motor that drives a gear rack.

Each of the cutters 4 is connected with two of the cutter fixing blocks 5 through each of the pins 13. A counter bore 20 is provided on each of the cutter fixing blocks 5 on the side of a pin bore 21. Each torsional spring 12 is wrapped around a corresponding pin 13. The torsional spring 12 is connected at one end to the cutter 4 and at its other end to one of the two cutter fixing blocks 5. The cutter installation structure is fixed on the cutter base by the bolts 11. The cutters 4 are tightly pressed against an outer wall of the energy absorption circular tube 2 by spring force of the torsional springs 12. Each pull ring 3 is mounted on a corresponding cutter 4. When mounting the energy absorption circular tube 2 or when the double-acting type air cylinder 9 pulls the energy absorption circular tube 2 to the interior of the guide cartridge 8, the energy absorption circular tube 2 may be separated from the cutters 4 by pulling the cutter 4 through the pull ring 3. Alternatively, an air cylinder for jacking up a cutter 4 may be mounted below the cutter 4 to separate the energy absorption circular tube 2 from the cutter 4. The cutters 4 mounted on the cutter base 7 are capable of rotating and separating from the energy absorption structure so that the cutters can be replaced after being damaged.

Figure 3:
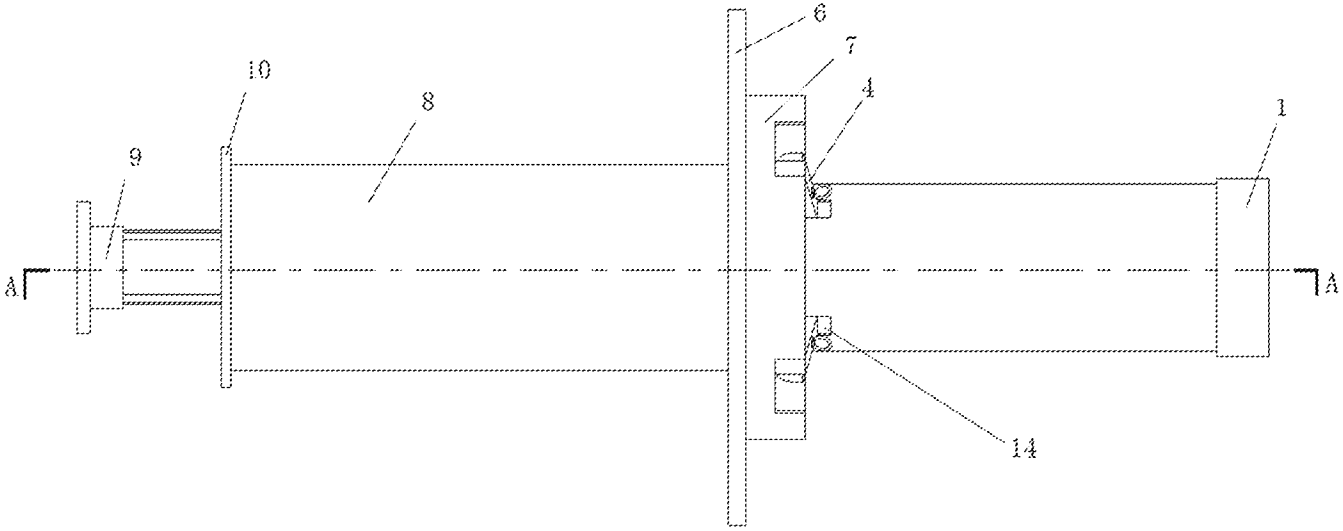
FIG. 3 is a top view of an energy absorption device according to the disclosure.
Figure 4:
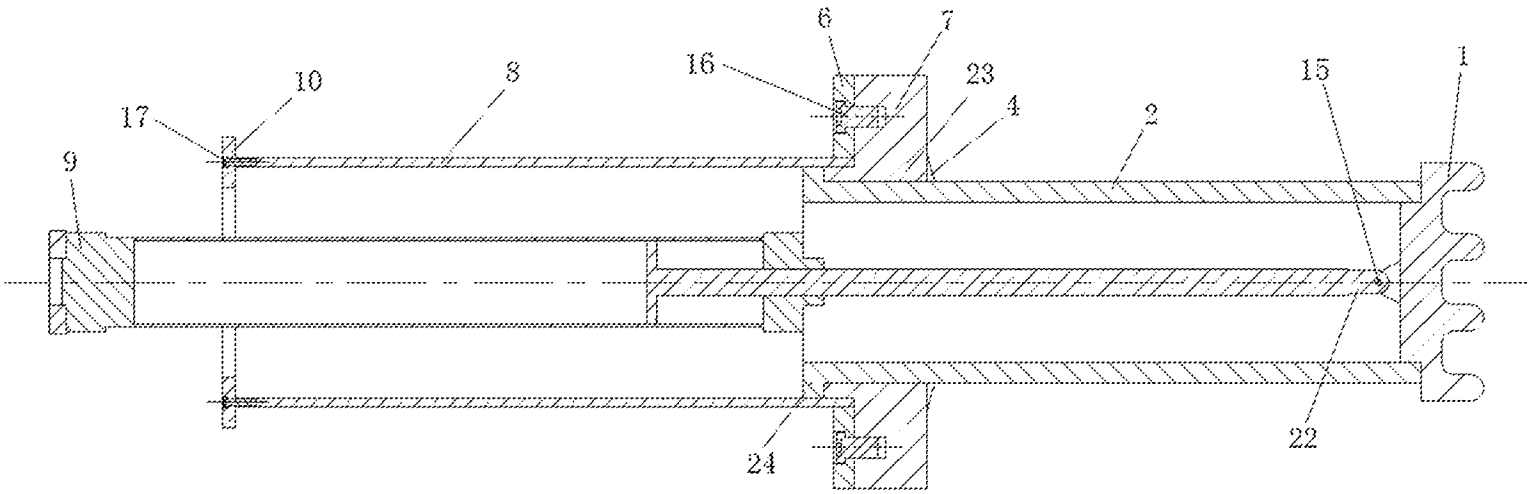
FIG. 4 is a sectional view along a line A-A of FIG. 3.

With reference to FIGS. 3 and 4, the mounting base 6 is connected to the cutter base 7 by bolts 16. One end of the guide cartridge 8 is welded on the cutter base 7 and the other end of the guide cartridge is connected to the base 10 by bolts 17. A piston end 22 of the double-acting type air cylinder 9 is connected with the anti-climber 1 by pin 15. The anti-climber 1 is mounted at the front end of the energy absorption circular tube 2 mating with an inner hole 23 of the cutter base 7, a rear end boss 24 of the energy absorption circular tube is in clearance fit with the interior of the guide cartridge 8. The energy absorption circular tube 2 may move in a longitudinal direction. The energy absorption circular tube 2 and the guide cartridge 8 may be circular or other shapes so long as a clearance fit is provided between them. Locating slots 14 that are in clearance fit with the cutters 4 are provided on the energy absorption circular tube 2. The cutters 4 may be tightly pressed in the locating slots 14 after the projection of the energy absorption circular tube 2. The energy absorption circular tube 2 can be made of aluminium or steel. After the energy absorption circular tube 2 is damaged by a collision, the energy absorption structure may simply be replaced during maintenance, without having to replace the entire device. When subjected to a certain vertical or lateral force, the energy absorption circular tube 2 may undergo a stable longitudinal deformation and move longitudinally along the guide cartridge 8.

Figure 5:
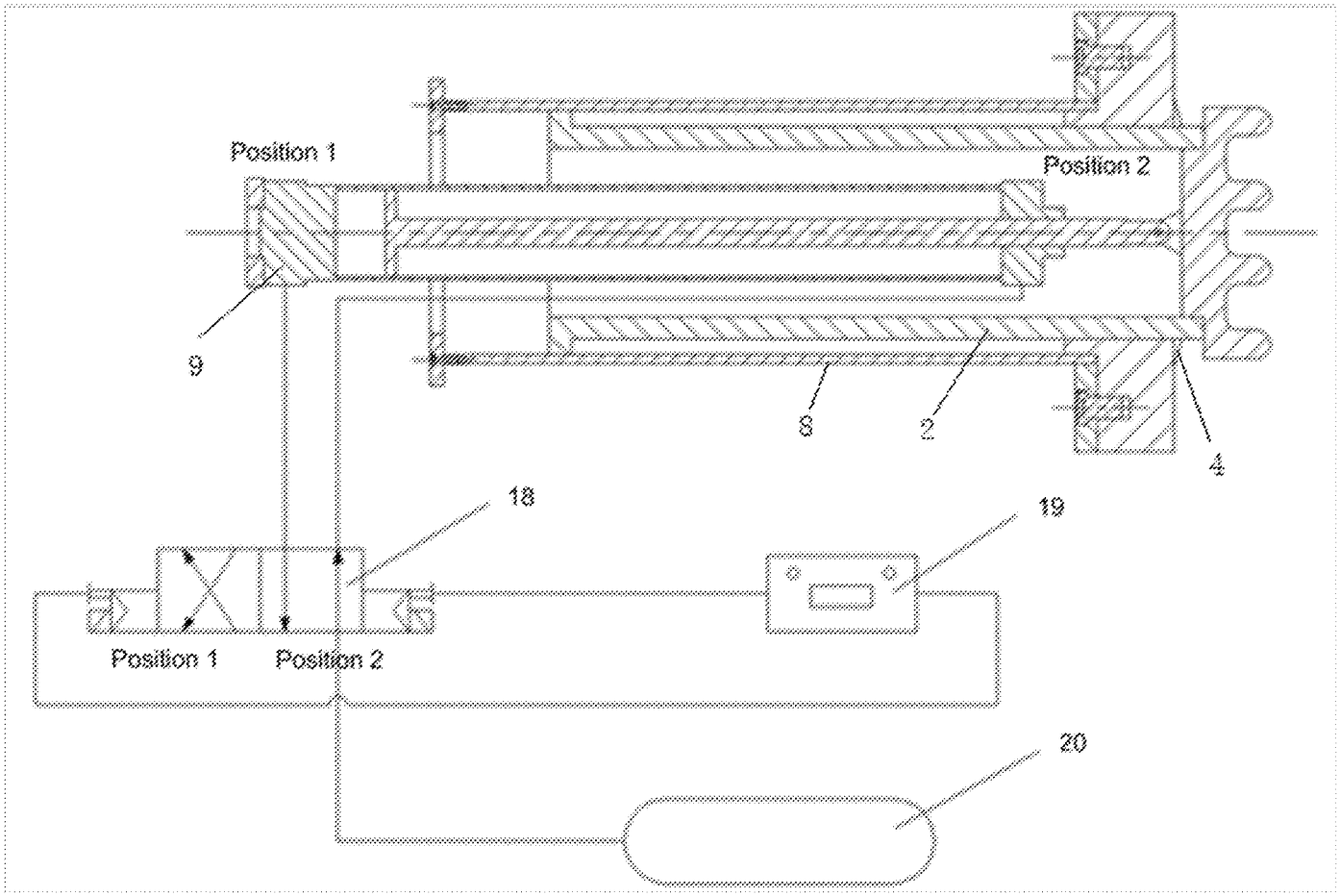
FIG. 5 is a principle diagram of the disclosure under a non-operating state.

As shown in FIG. 5, a control system of the energy absorption device includes a double-acting type solenoid valve 18, a controller 19 and an air storage tank 20. In a non-operating state, the high-pressure air already existing in the vehicle is used as a source power, the controller 19 activates a second position of the double-acting type solenoid valve 18, a second position of the double-acting type air cylinder 9 is inflated by the high-pressure air in the air storage tank 20 via a gas circuit, such that the double-acting type air cylinder 9 is in a state of tension where it pulls and hides the energy absorption circular tube 2 into the interior of the guide cartridge 8, the cutters 4 are pressed against the outer wall of the energy absorption circular tube 2.

Figure 6:
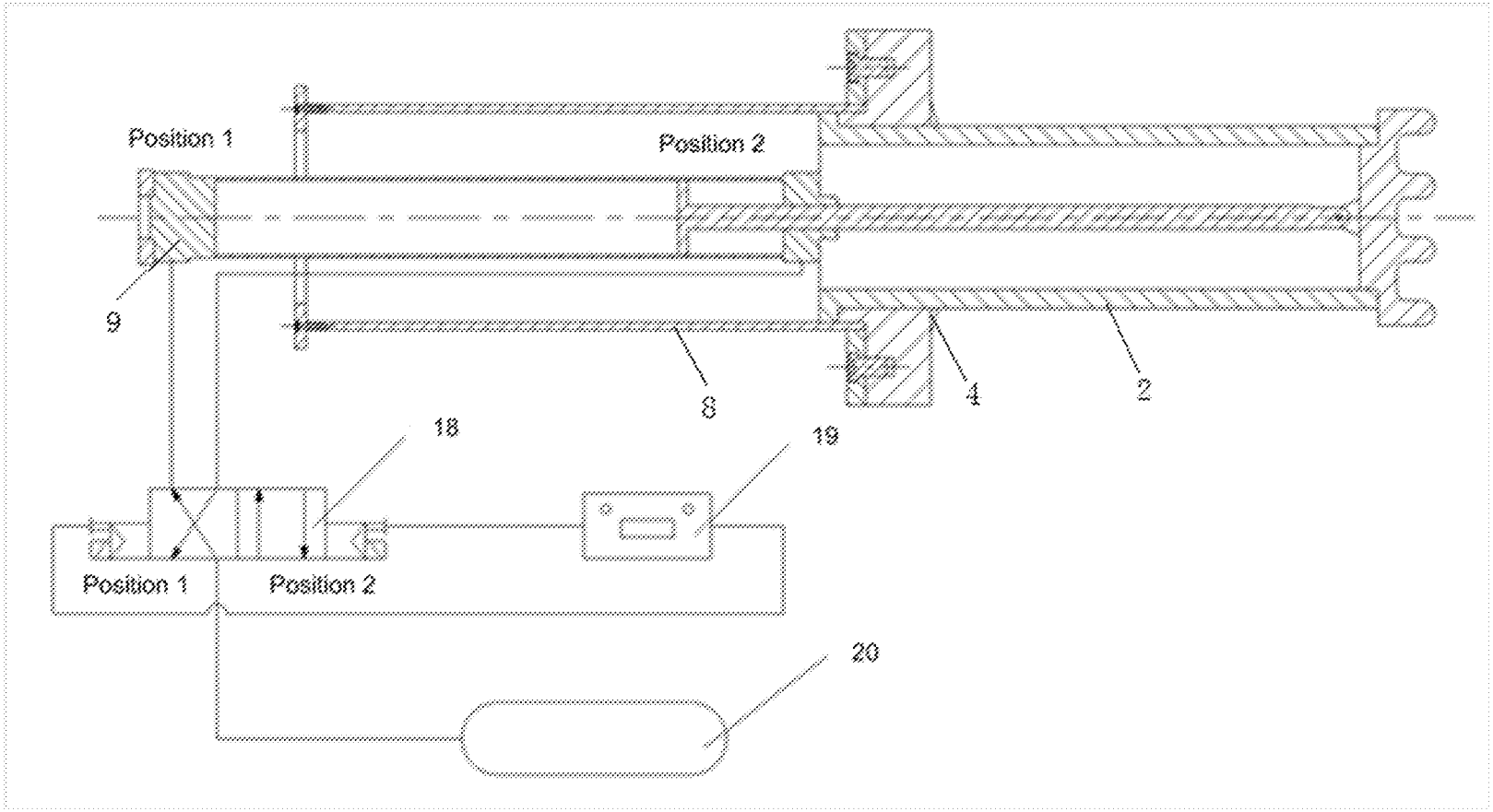
FIG. 6 is a principle diagram of the disclosure under an operating state.

As shown in FIG. 6, before the collision of the vehicle, the controller 19 activates a first position of the double-acting type solenoid valve 18, a first position of the double-acting type air cylinder 9 is inflated by the high-pressure air in the air storage tank 20 via the gas circuit, the energy absorption circular tube 2 is pushed by the double-acting type air cylinder 9 under the effect of the high-pressure air and is ejected outwards, the cutters 4 are pressed against the locating slots 14 of the energy absorption circular tube 2 under the effect of spring force, the cutters 4 cut the energy absorption circular tube 2 and absorb the momentum of the collision when the energy absorption circular tube 2 is subjected to an external force and retracts towards the interior of the guide cartridge 8. When the energy absorption circular tube 2 is subjected to an external pressure, there is no air pressure in the second position of the double-acting type air cylinder 9. If the energy absorption circular tube 2 is not subjected to the collision after it projects, the energy absorption circular tube 2 may be separated from the cutters 4 by pulling of the cutters 4 by the double-acting type air cylinder 9 to the interior of the guide cartridge 8.

The energy absorption device may be mounted on the rail vehicle and driven by the high-pressure air of the vehicle itself, or it may be mounted on a tool that requires the energy absorption, but this requires an additional provision of the high-pressure air.

An automatic control of the entire structure of the energy absorption device may be achieved by sensors mounted on the vehicle, or a manual control of it may also be implemented.

The invention claimed is:

1. A telescopic type collision energy absorption device for a rail vehicle, comprising a first tube and a second tube that can telescope within the first tube, the first tube being mounted with a cutting mechanism for cutting an outer wall of the second tube, wherein the energy absorption device comprises a telescopic mechanism connected with the second tube by passing through the first tube, the cutting mechanism comprises a cutter base and cutters mounted on the cutter base;

when the energy absorption device is in a non-operating state, the telescopic mechanism pulls the second tube in such a way that the second tube is retracted into interior of the first tube, the cutting mechanism is pressed against the outer wall of the second tube by the cutters; and in a state prior to a collision of the vehicle, the telescopic mechanism under an effect of a high-pressure air pushes the second tube in such a way that the second tube is ejected outwards, the cutters are capable of rotating and separating from the second tube, such that the cutters are again pressed, under an effect of a spring force, against locating slots of the second tube ejected outwards, and the cutters of the cutting mechanism cuts the second tube and absorbs energy when the second tube is subjected to an external force and retracts towards the interior of the first tube.

2. The telescopic type collision energy absorption device for a rail vehicle according to claim 1, wherein the telescopic mechanism is driven by a double-acting type air cylinder, or a double-acting type hydraulic cylinder, when the telescopic mechanism is driven by the double-acting type air cylinder, the telescopic mechanism comprises the double-acting type air cylinder, a double-acting type solenoid valve, an air storage tank and a controller; in the non-operating state, the controller activates a second position of the double-acting type solenoid valve in such a way that a second position of the double-acting type air cylinder is inflated by the high-pressure air in the air storage tank via a gas circuit, such that the double-acting type air cylinder is in a state of tension where it pulls and retracts the second tube into the interior of the first tube; and in the state prior to the collision of the vehicle, the controller activates a first position of the double-acting type solenoid valve in such a way that a first position of the double-acting type air cylinder is inflated by the high-pressure air in the air storage tank via a gas circuit, and the double-acting type air cylinder under the effect of the high-pressure air pushes the second tube in such a way that the second tube is ejected outwards.

3. The telescopic type collision energy absorption device for a rail vehicle according to claim 1, wherein the cutting mechanism further comprises cutter fixing blocks, bolts, torsional springs and pins, each cutter is connected with two of the cutter fixing blocks by one of the pins, a counter bore is provided on each of the two cutter fixing blocks on one side of a pin bore, each torsional spring is wrapped around a corresponding pin, the torsional spring is connected at one end to the cutter and at other end to one of the two cutter fixing blocks, the cutters are pressed against the second tube by spring force of the torsional springs; the cutter fixing blocks are fixed on the cutter base by the bolts.

4. The telescopic type collision energy absorption device for a rail vehicle according to claim 3, wherein each cutter is rotated and separated from the second tube by a pull ring or an air cylinder below the cutter for jacking up the cutter; the pull ring is mounted on the cutter, the cutter can be separated from the second tube by being pulled through the pull ring.

5. The telescopic type collision energy absorption device for a rail vehicle according to claim 1, wherein the first tube comprises a guide cartridge which is a hollow circular tube, the guide cartridge is provided at one end with a first flange part through which the guide cartridge is fixed to the cutter base, and the other end of the guide cartridge is connected to a base of the energy absorption device.

6. The telescopic type collision energy absorption device for a rail vehicle according to claim 5, wherein an inner end of the second tube is provided with a second flange part, the cutter base is provided with a third flange part embedded within the first tube, the second flange part is in clearance fit with an inner wall of the first tube, the position of the second flange part is limited by the third flange part.

7. The telescopic type collision energy absorption device for a rail vehicle according to claim 1, wherein an outer end of the second tube is provided with an anti-climber, an inner end of which is embedded in an inner chamber of the first tube, and the locating slots are provided on an outer wall of the inner end of the second tube.

8. A rail vehicle, wherein the rail vehicle is mounted with a telescopic type collision energy absorption device for a rail, the device comprises a first tube and a second tube that can telescope within the first tube, the first tube is mounted with a cutting mechanism for cutting an outer wall of the second tube, wherein the energy absorption device comprises a telescopic mechanism connected with the second tube by passing through the first tube, the cutting mechanism comprises a cutter base and cutters mounted on the cutter base;

when the energy absorption device is in a non-operating state, the telescopic mechanism pulls the second tube in such a way that the second tube is retracted into the interior of the first tube, the cutting mechanism is pressed against the outer wall of the second tube by the cutters; and in a state prior to a collision of the vehicle, the telescopic mechanism under an effect of a high-pressure air pushes the second tube in such a way that the second tube is ejected outwards, the cutters are capable of rotating and separating from the second tube, such that the cutters are again pressed, under an effect of a spring force, against locating slots of the second tube ejected outwards, and the cutters of the cutting mechanism cuts the second tube and absorbs energy when the second tube is subjected to an external force and retracts towards the interior of the first tube, the energy absorption device is mounted on a rail vehicle driven by a high-pressure air of the rail vehicle itself, or on a tool requiring energy absorption, which requires an additional provision of the high-pressure air; and the energy absorption device is automatically controlled by a sensor mounted on the rail vehicle, or controlled manually.

9. The rail vehicle according to claim 8, wherein two sets of the energy absorption devices are provided on the rail vehicle, and the two sets of the energy absorption devices are mounted respectively on either side of an end portion of the vehicle.

10. The telescopic type collision energy absorption device for a rail vehicle according to claim 2, wherein an outer end of the second tube is provided with an anti-climber, an inner end of which is embedded in an inner chamber of the first tube, and the locating slots are provided on an outer wall of the inner end of the second tube.

11. The telescopic type collision energy absorption device for a rail vehicle according to claim 3, wherein an outer end of the second tube is provided with an anti-climber, an inner end of which is embedded in an inner chamber of the first tube, and the locating slots are provided on an outer wall of the inner end of the second tube.

12. The telescopic type collision energy absorption device for a rail vehicle according to claim 4, wherein an outer end of the second tube is provided with an anti-climber, an inner end of which is embedded in an inner chamber of the first tube, and the locating slots are provided on an outer wall of the inner end of the second tube.

13. The telescopic type collision energy absorption device for a rail vehicle according to claim 5, wherein an outer end of the second tube is provided with an anti-climber, an inner end of which is embedded in an inner chamber of the first tube, and the locating slots are provided on an outer wall of the inner end of the second tube.

14. The telescopic type collision energy absorption device for a rail vehicle according to claim 6, wherein an outer end of the second tube is provided with an anti-climber, an inner end of which is embedded in an inner chamber of the first tube, and the locating slots are provided on an outer wall of the inner end of the second tube.

15. The rail vehicle according to claim 8, wherein the telescopic mechanism is driven by a double-acting type air cylinder, ora double-acting type hydraulic cylinder, when the telescopic mechanism is driven by the double-acting type air cylinder, the telescopic mechanism comprises the double-acting type air cylinder, a double-acting type solenoid valve, an air storage tank and a controller; in the non-operating state, the controller activates a second position of the double-acting type solenoid valve in such a way that a second position of the double-acting type air cylinder is inflated by the high-pressure air in the air storage tank via a gas circuit, such that the double-acting type air cylinder is in a state of tension where it pulls and retracts the second tube into the interior of the first tube; and in the state prior to the collision of the vehicle, the controller activates a first position of the double-acting type solenoid valve in such a way that a first position of the double-acting type air cylinder is inflated by the high-pressure air in the air storage tank via a gas circuit, and the double-acting type air cylinder under the effect of the high-pressure air pushes the second tube in such a way that the second tube is ejected outwards.

16. The rail vehicle according to claim 8, wherein the cutting mechanism further comprises cutter fixing blocks, bolts, torsional springs and pins, each cutter is connected with two of the cutter fixing blocks by one of the pins, a counter bore is provided on each of the two cutter fixing blocks on one side of a pin bore, each torsional spring is wrapped around a corresponding pin, the torsional spring is connected at one end to the cutter and at other end to one of the two cutter fixing blocks, the cutters are pressed against the second tube by spring force of the torsional springs; the cutter fixing blocks are fixed on the cutter base by the bolts.

17. The rail vehicle according to claim 16, wherein each cutter is rotated and separated from the second tube by a pull ring or an air cylinder below the cutter for jacking up the cutter; the pull ring is mounted on the cutter, the cutter can be separated from the second tube by being pulled through the pull ring.

* * * * *